US007273355B2

(12) United States Patent
Collings

(10) Patent No.: US 7,273,355 B2
(45) Date of Patent: Sep. 25, 2007

(54) COMPRESSOR ASSEMBLY WITH PISTON HAVING MULTIPLE CROSS SECTIONS

(75) Inventor: Douglas A Collings, Tecumseh, MI (US)

(73) Assignee: Tecumseh Products Company, Tecumseh, MI (US)

( * ) Notice: Subject to any disclaimer, the term of this patent is extended or adjusted under 35 U.S.C. 154(b) by 545 days.

(21) Appl. No.: 10/736,348

(22) Filed: Dec. 15, 2003

(65) Prior Publication Data

US 2005/0129542 A1 Jun. 16, 2005

(51) Int. Cl.
*F04B 39/10* (2006.01)
*F16J 1/04* (2006.01)

(52) U.S. Cl. ..... 417/53; 417/571; 92/208

(58) Field of Classification Search ..... 417/415, 417/312, 571, 53; 92/208, 169.1, 140, 152
See application file for complete search history.

(56) References Cited

U.S. PATENT DOCUMENTS

| | | | | |
|---|---|---|---|---|
| 1,398,178 | A | 11/1921 | Lukacsevics et al. | |
| 2,753,231 | A | 7/1956 | Nallinger | 309/8 |
| 3,204,864 | A * | 9/1965 | Malaker et al. | 92/134 |
| 3,601,505 | A | 8/1971 | Bratsch | 417/266 |
| 4,383,804 | A | 5/1983 | Budzich | 417/267 |
| 4,559,686 | A | 12/1985 | Kessler | 29/156.5 R |
| 4,627,795 | A * | 12/1986 | Schmitz-Montz | 417/267 |
| 4,683,810 | A | 8/1987 | Afimiwala | 92/212 |
| 4,718,830 | A | 1/1988 | Middleton et al. | 417/372 |
| 4,852,463 | A | 8/1989 | Wagenseil | 91/488 |
| 5,499,571 | A | 3/1996 | Dreiman | 92/187 |
| 6,089,835 | A | 7/2000 | Suzuura et al. | 417/415 |
| 6,272,750 | B1 | 8/2001 | Pflager et al. | 29/898.02 |
| 6,287,092 | B1 | 9/2001 | Calciolari et al. | 417/415 |
| 6,368,085 | B1 | 4/2002 | Collings | 417/569 |

FOREIGN PATENT DOCUMENTS

| | | |
|---|---|---|
| DE | 1 088 182 | 9/1960 |
| EP | 0 300 274 | 1/1989 |
| FR | 1.278.604 | 12/1961 |

* cited by examiner

*Primary Examiner*—Anthony Stashick
*Assistant Examiner*—Vikansha Dwivedi
(74) *Attorney, Agent, or Firm*—Baker & Daniels LLP

(57) ABSTRACT

A compressor assembly having a piston with multiple cross sections. The compressor assembly, in one form thereof, includes a cylinder block defining a cavity. A piston is at least partially disposed in the cavity and reciprocates along a central axis of the cavity. The piston includes a first piston portion and a second piston portion. The first piston portion has a cross sectional configuration and area substantially similar to a first portion of the cavity and the second piston portion has a radially outer surface at least partially engageable with the sidewall of a second portion of the cavity. The second piston portion may also have a larger cross sectional area than the first portion of the piston which may be used to compress a refrigerant within the cavity.

19 Claims, 6 Drawing Sheets

COMPRESSOR ASSEMBLY WITH PISTON HAVING MULTIPLE CROSS SECTIONS

BACKGROUND OF THE INVENTION

1. Field of the Invention

The present invention relates to reciprocating compressors, and more particularly, to reciprocating compressors having an improved piston design.

2. Description of the Related Art

Conventional reciprocating compressors commonly include a hermetically sealed housing defining an interior plenum. The housing includes a suction inlet and a discharge outlet, through which a compressible fluid respectively enters and exits the compressor assembly. A motor is generally disposed in the interior plenum to rotationally drive a shaft. The shaft typically includes a journal that defines an axis offset from the rotational axis of the shaft thereby causing the journal to travel through a circular arc centered on the rotational axis of the shaft. A cylinder block will also generally be disposed in the interior plenum and define a compression cylinder having a single diameter. A substantially cylindrical piston having a single diameter is disposed within the cylinder. A wrist pin is often used to connect the piston with a piston rod. The piston rod is also secured to the journal whereby the rotational motion of the shaft is converted to reciprocating movement of the piston along the axis of the compression cylinder. The compressible fluid is drawn into the cylinder and compressed by the reciprocation of the piston within the cylinder.

Converting the rotational movement of the shaft into the reciprocating movement of the piston generates side loads that are transverse to both the rotational axis of the shaft and to the axis of the cylinder. These side loads typically result in a portion of the piston bearing against the sidewall of the cylinder. Normal operation of the compressor may also result in a relatively large load being placed on the wrist pin that connects the piston rod with the piston. When using a refrigerant that must be compressed to a relatively high pressure, such as carbon dioxide, these loads can become significant and may, thereby, adversely affect the performance and durability of a conventional reciprocating compressor design.

SUMMARY OF THE INVENTION

The present invention provides a compressor assembly having a piston with multiple cross sections. By providing the piston with multiple cross sections, the piston may have an enlarged section that allows relatively large bearing surfaces to be used for engagement with a wrist pin and/or a sidewall of the cylinder in which the piston is disposed.

The compressor assembly of the present invention, in one form thereof, includes a cylinder block defining a cavity having a first cavity portion and a second cavity portion. The cavity defines a central axis extending through each of the first and second cavity portions. The first and second cavity portions, respectively, include first and second cavity sidewalls extending substantially parallel to the central axis. A cross section of the first cavity portion oriented perpendicular to the central axis defines a first cross sectional configuration and area. A cross section of the second cavity portion oriented perpendicular to the central axis defines a second cross sectional configuration and area. The second cross sectional area is greater than the first cross sectional area and the entire first cross sectional area is in communication with the second cavity portion. The compressor assembly defines an inlet and an outlet, both in communication with the first cavity portion, by which a compressible fluid enters the first cavity portion at a suction pressure and is discharged at a discharge pressure. A piston is at least partially disposed in the cavity and reciprocates along the central axis, the piston includes a first piston portion and a second piston portion. The first piston portion has a cross sectional configuration and area substantially similar to the first cavity portion configuration and area. The second piston portion has a radially outer surface at least partially engageable with the second cavity sidewall. During reciprocation of the piston within the cavity, the first piston portion compresses the fluid in the first cavity portion and forces transverse to the central axis are transferable between the radially outer surface of the second piston portion and the second cavity sidewall.

The compressor assembly of the present invention includes, in another form thereof, a cylinder block defining a cavity having a first substantially cylindrical cavity portion and a second substantially cylindrical cavity portion. The first and second cavity portions are coaxially disposed and define a central axis. The second cavity portion defines a larger diameter than the first cavity portion. The compressor assembly defines an inlet in communication with the first cavity portion and an outlet in communication with the first cavity portion, whereby a compressible fluid enters the first cavity portion through the inlet at a suction pressure and is discharged through the outlet at a discharge pressure. A piston is at least partially disposed in the cavity such that the piston reciprocates along the central axis. The piston includes a first piston portion and a second piston portion. The first piston portion defines a cylindrical shape substantially similar to the first cavity portion. The second piston portion has a radially outer surface at least partially engageable with a sidewall of the second cavity portion. A crankshaft having a rotational axis is disposed substantially perpendicular to the central axis. A linkage assembly drivingly couples the crankshaft to the piston. During reciprocation of the piston in the cavity, the first piston portion compresses a fluid in the first cavity portion, and forces transverse to the central axis are transferable between the radially outer surface of the second piston portion and the sidewall of the second cavity portion.

The present invention also comprises, in another form thereof, a method of compressing a refrigerant vapor. The method includes the steps of providing a cylinder block having a cavity; providing a piston defining a piston axis and having a first piston portion and a second piston portion, wherein a cross section of the first piston portion oriented perpendicular to the piston axis defines a first cross sectional area and a cross section of the second piston portion oriented perpendicular to the piston axis defines a second cross sectional area, the second cross sectional area being greater than the first cross sectional area; disposing the piston at least partially within the cavity, the first piston portion defining a compression chamber within the cavity; reciprocating the piston along a central axis of the cavity by drivingly engaging the second piston portion; and compressing the refrigerant in the compression chamber with the first piston portion as the piston is reciprocated.

One advantage of the present invention is that by providing a piston with multiple cross sections that portion of the piston coupled to a linkage assembly may be relatively larger thereby allowing the piston and linkage assembly to define relatively large bearing surfaces and relatively large dimensions thereby facilitating the reduction of the stress applied to the materials of the piston and linkage assembly.

Another advantage of the present invention is that by providing a piston with multiple cross sections, one portion of the piston may be used to compress or displace a fluid and the other portion of the piston may be used to guide the movement of the piston and transfer side loads between the piston and a sidewall of the cylinder in which the piston is located.

These advantages are particularly useful when the compressor is used with a refrigerant that must be compressed to a relatively high pressure such as carbon dioxide.

BRIEF DESCRIPTION OF THE DRAWINGS

The above mentioned and other features and objects of this invention, and the manner of attaining them, will become more apparent and the invention itself will be better understood by reference to the following description of the embodiments of the invention taken in conjunction with the accompanying drawings, wherein.

Figure 1:
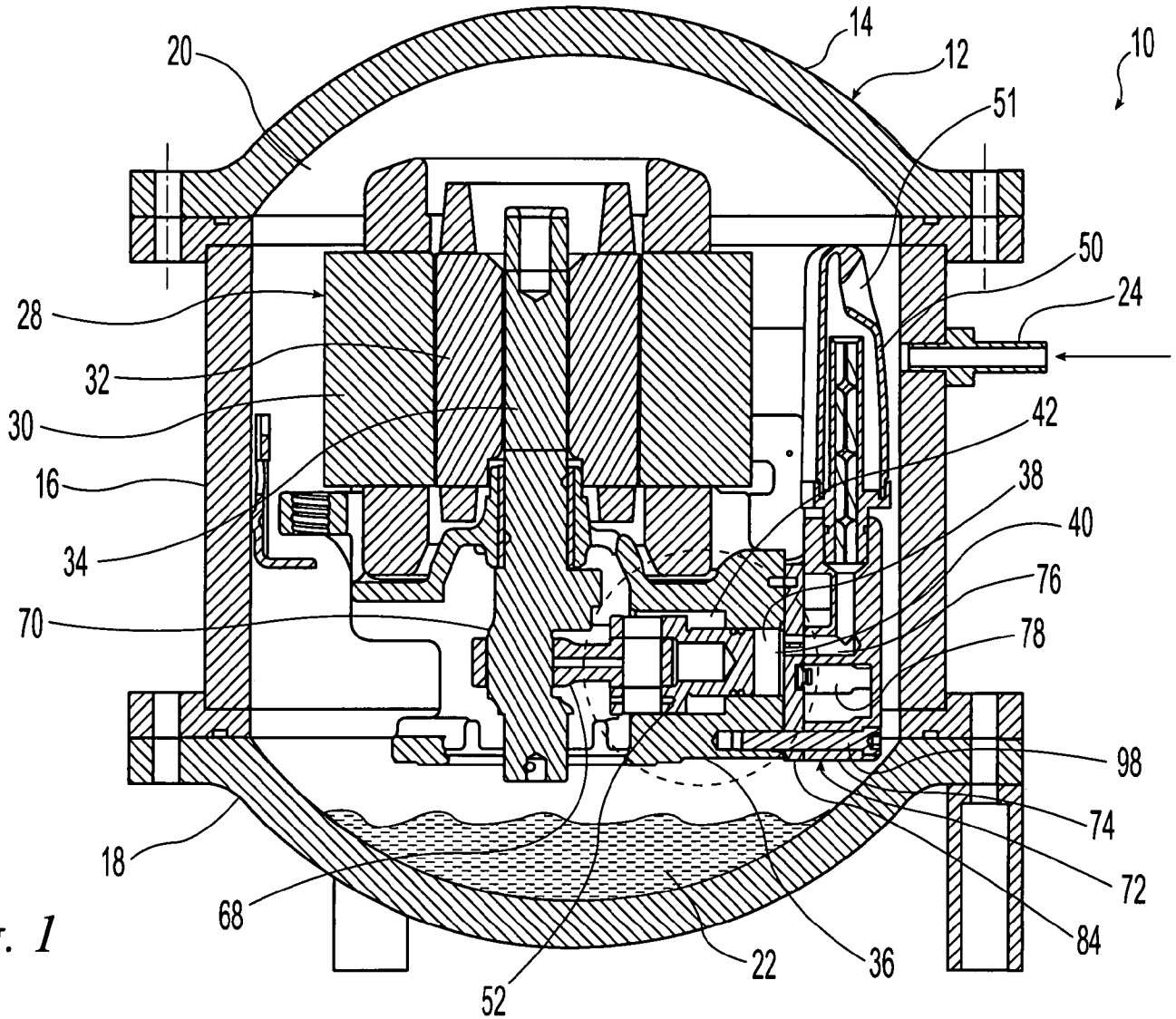
FIG. 1 is a sectional view of a reciprocating compressor in accordance with one embodiment of the present invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DESCRIPTION OF THE PRESENT INVENTION

Referring first to FIG. 1, compressor assembly 10 comprises a housing 12, which includes upper housing member 14, lower housing member 18, and cylindrical main housing member 16. Housing members, 14, 16 and 18 are hermetically sealed to one another to define interior volume 20. A portion of interior volume 20 bordered by lower housing member 18 forms oil sump 22. Main housing member 16 includes suction inlet 24 by which a compressible fluid, e.g., carbon dioxide or other suitable refrigerant, enters interior volume 20 at suction pressure. Main housing member 16 also includes a discharge outlet through which the compressed refrigerant is discharged from compressor 10. Motor assembly 28 is disposed within interior volume 20 and includes stator 30 and rotor 32. Motor assembly 28 is a conventional motor and is connected to an electrical power source (not shown). Shaft 34 is secured to rotor 32 whereby motor 28 rotationally drives shaft 34.

Figure 2:
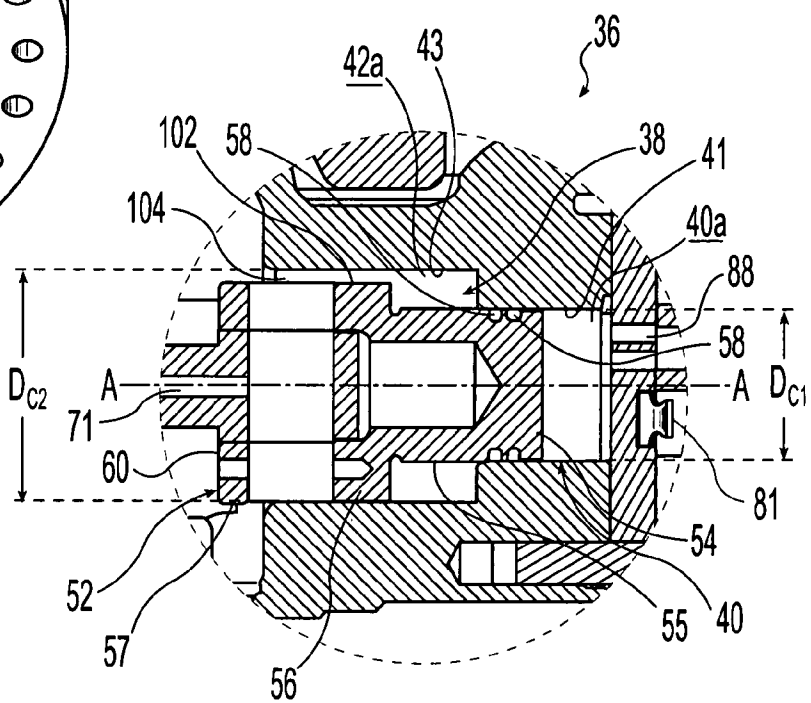
FIG. 2 is an enlarged view of the encircled region in FIG. 1.

Referring now to FIGS. 1-2, cylinder block 36 is mounted in interior volume 20. Cylinder block 36 defines stepped cavity 38, which includes a compression cavity or first cavity portion 40 and a guide cavity or second cavity portion 42. Compression cavity 40 and guide cavity 42 are aligned along a common central axis A, which is perpendicular to the rotational axis 33 of shaft 34. As illustrated in FIG. 2, compression cavity 40 and guide cavity 42 are formed by sidewalls 41, 43, respectively, which define cylinders centered about central axis A. Compression cavity 40 and guide cavity 42 have diameters $D_{C1}$ and $D_{C2}$, respectively. Diameter $D_{C2}$ of guide cavity 42 is greater than diameter $DC_{C1}$ of compression cavity 40. Thus, a cross section of guide portion 42 taken along a line perpendicular to central axis A defines an area larger than the area of a cross sectional area of compression cavity 40 taken along a line perpendicular to central axis A. Compression cavity 40 is disposed adjacent guide cavity 42 such that the entire cross sectional area of compression cavity 40 is in communication with guide cavity 42 whereby the compression portion 54 of piston 52 may be inserted into compression cavity 40 from guide cavity 42. Inlet openings 88 and outlet 86 are in communication with compression cavity 40 to allow a fluid to respectively enter and exit compression cavity 40 as discussed in greater detail below.

A one-piece stepped piston 52 is reciprocatingly disposed along central axis A within stepped cavity 38. As shown in FIGS. 2 and 4-7, stepped piston 52 includes a first or compression portion 54, which is at least partially disposed within compression cavity 40 and, together with piston rings 58, cooperates with sidewall 41 to define compression chamber **40*a* within which a compressible fluid, e.g., carbon dioxide, is compressed as discussed in greater detail below. Stepped piston 52 also includes a second or guiding portion 56, which is at least partially disposed within guide cavity 42 and bears against sidewall 43 to transfer side loads from piston 52 to cylinder block 36. As piston 52 reciprocates within stepped cavity 38, guide portion 56 and sidewall 43 define a variable volume space 42*a* within guide cavity 42**.

Compression portion 54 and guide portion 56 include radially outer surfaces 55, 57 each of which have a shape that is substantially cylindrical. Axially adjacent compression portion 54 and guide portion 56 are coaxial and when positioned in stepped cavity 38 the axes of compression portion 54 and guide portion 56 are aligned and collinear with axis A of cavity 38 as best seen in FIG. 2.

In the illustrated embodiment, piston 52 is formed from a single integral metal casting. In alternative embodiments, compression and guide portions 54, 56 may be formed separately and then affixed together using fasteners, welding or other suitable means.

Figure 5:
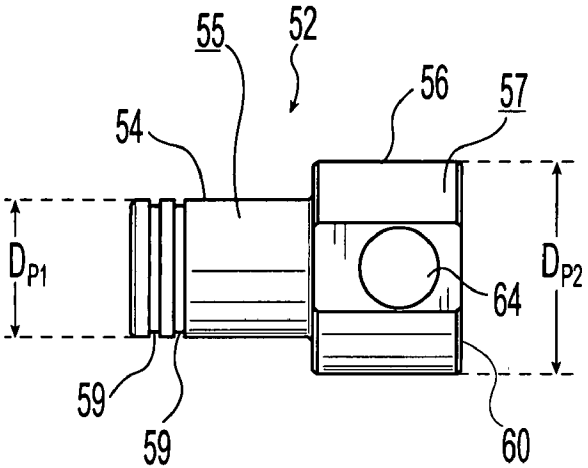
FIG. 5 is a side view of the piston of FIG. 4.

As shown in FIG. 5, compression portion 54 and guide portion 56 define diameters $D_{P1}$ and $D_{P2}$, respectively. Diameter $D_{P1}$ is smaller than diameter $D_{P2}$ and is sized such that a first clearance distance is defined between outer surface 55 of compression portion 54 and sidewall 41 of compression cavity 40. Diameter $D_{P2}$ is sized such that a second clearance distance is defined between outer surface 57 of guide portion 56 and sidewall 43 of guide cavity 42. In the illustrated embodiment, stepped piston 52 and stepped cavity 38 are configured so that the second clearance distance (within guide cavity 42) is smaller than the first clearance distance (within compression cavity 40) when stepped piston 52 is centered in stepped cavity 38. By providing a smaller clearance distance between the guide portion of the piston and a corresponding cylinder sidewall than between the compression portion of the piston and a corresponding cylinder sidewall, movement of the piston transverse to the axis of the piston will generally result in the guide portion of the piston contacting a sidewall of the stepped cylinder prior to the compression portion of the piston. Although flat 102 defines a gap 104 that is larger than the first clearance distance between compression portion 54 and sidewall 41, gap 104 extends over only a portion of the outer perimeter of guide portion 56 and in only limited situations would outer surface 55 contact sidewall 41 prior to outer surface 57 contacting sidewall 43.

Figure 4:
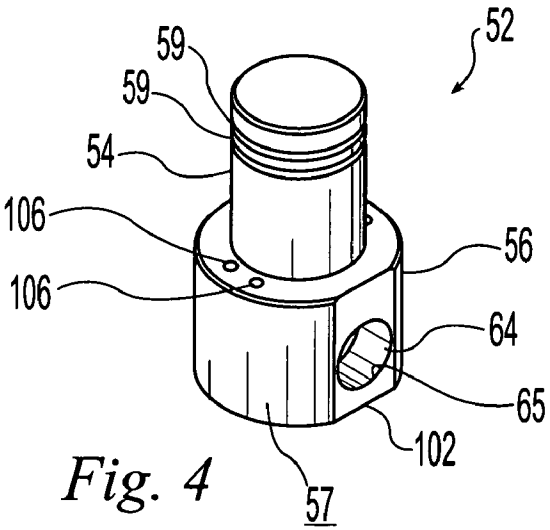
FIG. 4 is a perspective view of a piston for a reciprocating compressor in accordance with one embodiment of the present invention.
Figure 6:
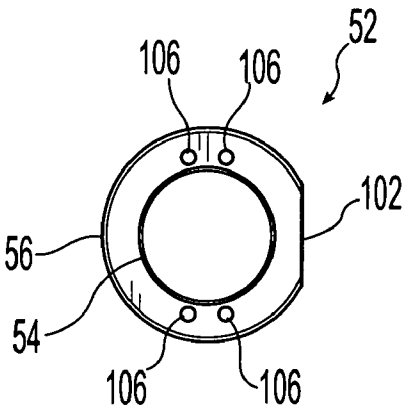
FIG. 6 is an end view of the piston of FIG. 4.
Figure 7:
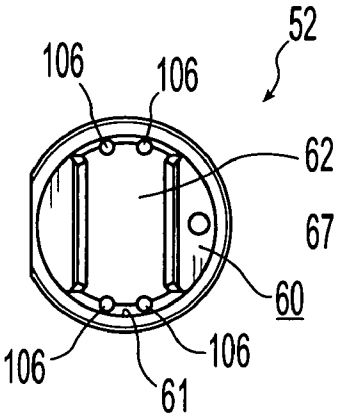
FIG. 7 is another end view of the piston of FIG. 4.
Figure 8:
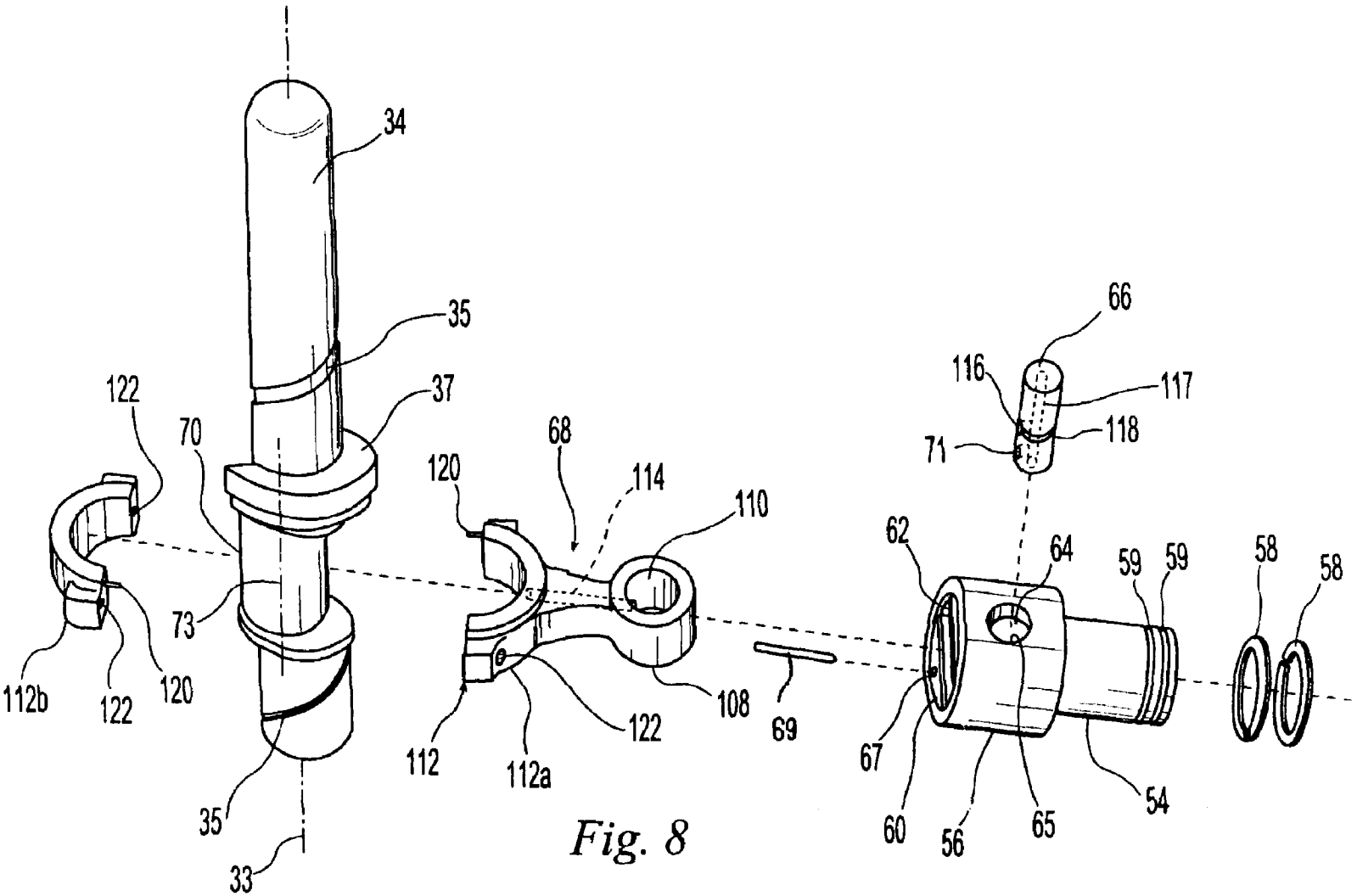
FIG. 8 is an exploded view of a shaft/connecting rod/piston assembly of a reciprocating compressor in accordance with one embodiment of the present invention.

Referring to FIGS. 4-7, a pair of piston ring grooves 59 are defined in outer surface 55 of piston 52 and extend about the perimeter of compression portion 54. Piston rings 58 are mounted within grooves 59 and engage both sidewall 41 of compression cavity 40 and compression portion 54 to provide a seal therebetween as shown in FIG. 2. Turning to FIGS. 7 and 8, guide piston 56 includes an end face 60 opposite compression portion 54. End face 60 includes central opening 61, which leads to central void 62 defined within guide portion 56. End face 60 also includes hole 67. As shown in FIGS. 4 and 8, guide portion 56 includes elongate transverse void 64, which extends perpendicular to and intersects central void 62. Outer surface 57 defines aligned openings 65 on opposite sides of guide portion 56 which intersect transverse void 64.

Turning to FIGS. 1 and 8, piston 52 is operably connected to shaft 34 via a linkage member 68. Illustrated linkage member 68 takes the form of a connecting or piston rod as described below. Piston rod 68 includes an integral sleeve portion 108 at one end and a two-piece sleeve portion 112 at the opposite end. Sleeve 108 is sized and shaped to fit within central void 62 of guide portion 56. A bore 110 extends through sleeve 108 and aligns with transverse void 64 when sleeve 108 is disposed within central void 62 of piston 52. Wrist pin 66 fits within transverse void 64 and bore 110 to thereby pivotally secure piston rod 68 with piston 52. After positioning wrist pin in transverse void 64 and bore 110, a locking pin 69 is inserted through opening 67 in end face 60 of guide piston 56 and into hole 71 on wrist pin 66 to thereby secure wrist pin 66 in place within bore 110 and transverse void 64.

Referring still to FIG. 8, two-piece sleeve 112 of piston rod 68 includes first sleeve piece 112*a* and second sleeve piece 112*b* which is attachable to first piece 112*a*. First and second pieces 112*a*, 112*b* include pins 120 which engage receiving holes (not shown) on pieces 112*a*, 112*b* to align pieces 112*a*, 112*b* to one another. Pieces 112*a*, 112*b* are then secured with fasteners (not shown) inserted through fastener holes 122. Shaft 34 includes journal portion 70, as shown in FIGS. 1 and 8, which defines an axis 73 offset from and parallel to the rotational axis 33 of shaft 34. Bearing portion 112 engages journal portion 70 by positioning pieces 112*a*, 112*b* around journal portion 70 and securing pieces 112*a*, 112*b* to one another. A bearing or bushing may also be positioned between journal 70 and sleeve 112. Similarly, a bearing or bushing may be mounted within sleeve 108 to engage wrist pin 66. A counterweight 37 is provided on shaft 34 to offset the eccentric loads placed on shaft 34 by journal 70.

As illustrated in FIGS. 1 and 8, piston rod 68 defines a lubrication passage 114 which extends between opposite ends of piston rod 68. Lubrication passage 114 communicates with lubrication opening 116 and lubrication groove 118 in wrist pin 66 when wrist pin 66 is disposed within bore 110 of piston rod 68. Lubrication groove 118 is defined in the outer wall of wrist pin 66 and extends about the circumference of wrist pin 66. Passage 114 and groove 118 cooperate to provide oil to, and lubricate, the engagement between wrist pin 66 and sleeve 108. Excess oil passes through opening 116 and downwardly through the central bore 117 within wrist pin 66. Central bore 117 is open at is bottom end whereby oil may pass out through the lower end of central bore 117 and the lower opening 65 in piston 52 in which the lower end of pin 66 is located. A conventional oil pump mechanism (not shown) pumps oil from sump 22 upwardly to lubricate shaft 34 and other components of compressor assembly 10. Helical grooves 35 are placed in shaft 34 to lift oil upwardly along shaft 34 as shaft 34 rotates.

Figure 9:
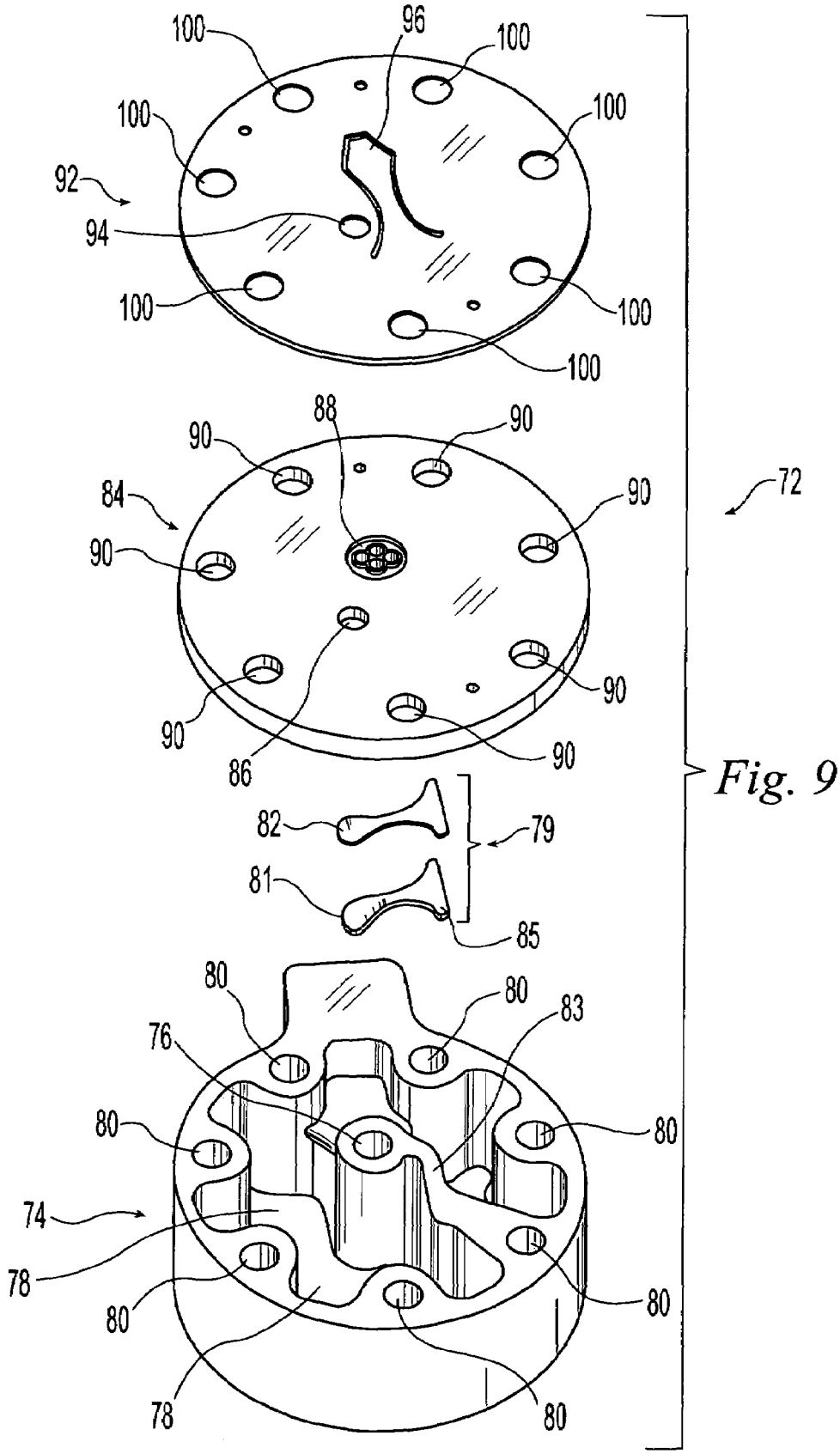
FIG. 9 is an exploded view of a cylinder head assembly of a reciprocating compressor in accordance with one embodiment of the present invention.
Figure 10:
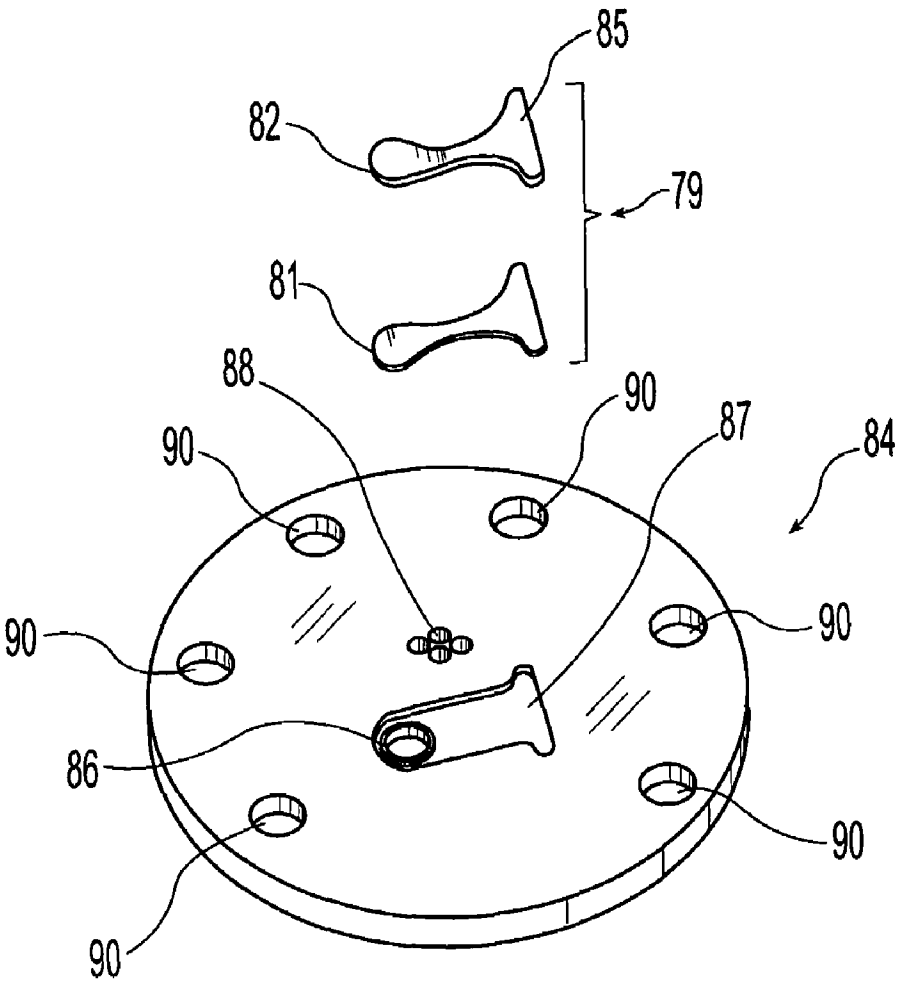
FIG. 10 is an exploded view of the valve plate and outlet valve assembly of FIG. 9.

Referring now to FIGS. 1-3 and 9-10, cylinder head assembly 72 is mounted on cylinder block 36 adjacent compression cavity 40. As illustrated in FIG. 9, cylinder head assembly 72 includes cylinder head 74, valve plate 84 and valve member 92. Valve member 92 is a substantially planar sheet material and includes outlet opening 94, inlet valve 96 and a plurality of fastener receiving holes 100. Valve member 92 may be formed of a Swedish valve steel. Valve plate 84 is substantially cylindrical and includes outlet opening 86, inlet opening 88, and a plurality of fastener receiving holes 90. As shown in FIG. 10, the lower surface of valve plate 84 defines recess 87 surrounding and extending from outlet opening 86. Recess 87 is shaped to receive outlet valve assembly 79, which includes flexible valve member 82 and rigid valve stop 81. As can be seen in FIG. 9, cylinder head 74 defines discharge chamber 78, inlet passageway 76, and a plurality of fastener receiving holes 80.

Figure 3:
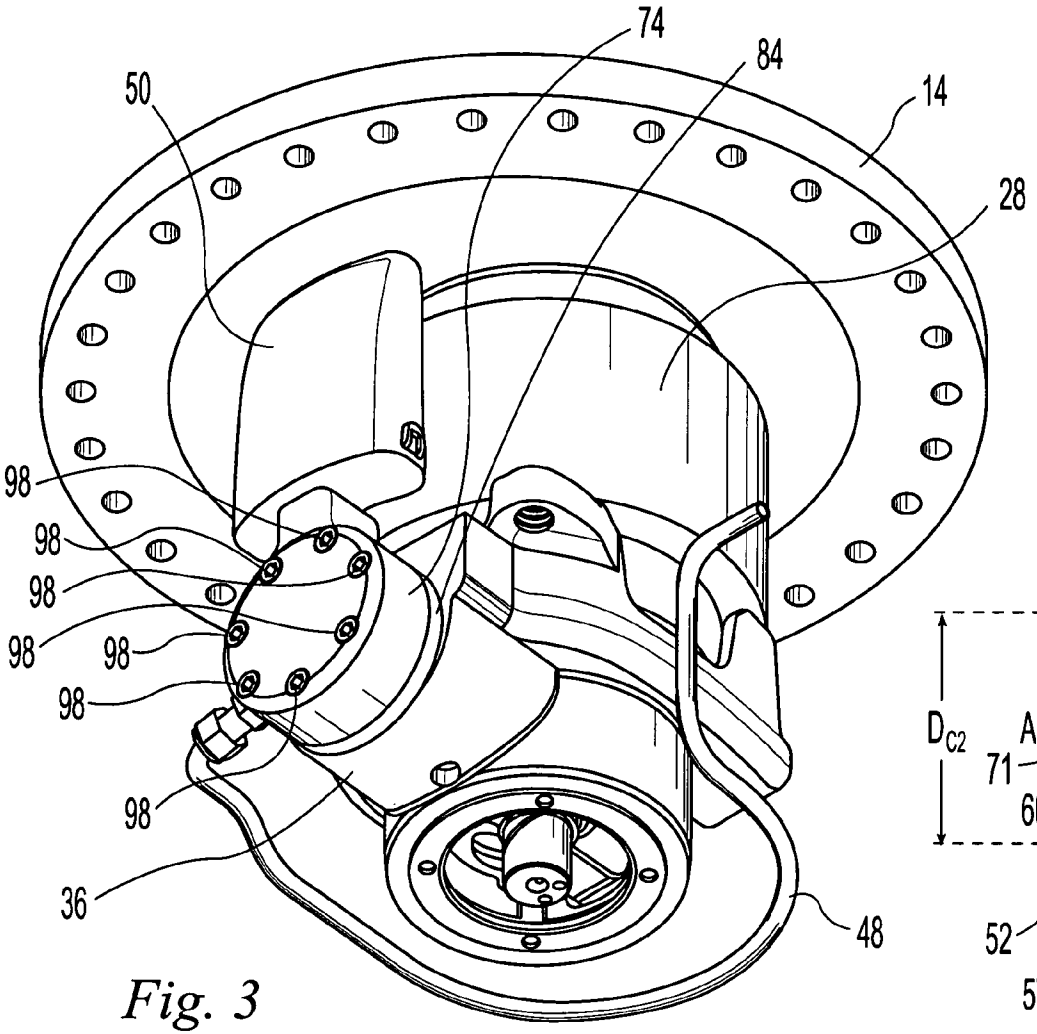
FIG. 3 is a perspective view of the reciprocating compressor of FIG. 1 with a portion of the housing removed.

Turning now to FIGS. 1, 3 and 8, valve member 92, valve plate 84 and cylinder head 74 are assembled to one another by aligning holes 100, 90 and 80 and inserting fasteners 98 therein. As shown in FIGS. 1 and 2, fasteners 98 engage aligned fastener receiving holes in cylinder block 36 to affix cylinder head assembly 72 to cylinder block 36. When cylinder head assembly 72 is secured to cylinder block 36, inlet passageway 76 of cylinder head 74 is aligned with inlet opening 88 of valve plate 84 and flexible inlet valve 96 defined by a slot cut in valve member 92. Similarly, outlet opening 86, outlet opening 94 and discharge chamber 78 are aligned with one another when cylinder head assembly 72 is assembled.

As can be seen in FIG. 8, separate projecting lips encircle each of the four individual openings that form inlet 88. Inlet valve 96 engages each of the projecting lips to seal inlet 88. Similarly, as seen in FIG. 9, a projecting lip encircles outlet 86 and defines the surface against which valve member 81 sealingly engages. Providing a small projecting lip about the openings forming inlet 88 and outlet 86 facilitates a good sealing engagement with the valve member. One-way check valve assembly 79 includes resilient valve member 82 and rigid valve stop 81. Valve stop 81 limits the deflection of valve member 82 to limit the stresses placed on valve member 82 during operation of compressor 10. Securement of valve plate 84 to cylinder head 74 secures valve member 81 and valve stop 82 in position within recess 87 by the engagement of partition member 83 in cylinder head 74 against the laterally extending portion 85 of valve stop 82. Outlet opening 94 in valve member 92 allows compression cavity 40 to be in fluid communication with outlet 86.

As shown in FIG. 1, suction muffler 50 is attached to cylinder head 74. Suction muffler 50 includes suction inlet 51 which receives refrigerant from interior volume 20. Refrigerant entering suction inlet 51 passes through suction muffler 50 and then enters L-shaped inlet passageway 76 of cylinder head 74. An internal discharge line 48 is disposed within interior volume 20 and is connected at one end to discharge chamber 78. The opposite end of discharge line 48 is mounted in housing 12 and defines the discharge outlet of compressor assembly 10.

In operation, motor 28 rotationally drives shaft 34 about axis 33. A linkage assembly including piston rod 68 and wrist pin 66 couples shaft 34 to piston 52. Axis 73 of journal portion 70 is offset from rotational axis 33 of shaft 34 as seen in FIG. 8 and journal portion 70 cooperates with piston rod 68 to convert the rotational motion of shaft 34 into the reciprocating motion of piston 52 along central axis A.

As piston rod 68 drives piston 52, sleeve 112 and journal 70 as well as sleeve 108 and wrist pin 66 are subject to relative rotational movement and the transfer of forces therebetween. By providing an enlarged guide portion 56 on stepped piston 52, the size of wrist pin 66 and sleeve 108 may be larger than if sleeve 108 and wrist pin 66 were connected within compression portion 54. Similarly, the area of contact between pin 66 and piston 52 may also thereby be relatively larger. Providing a guide portion 56, wrist pin 66 and sleeve 108 that have relatively large bearing surface areas facilitates the reduction of the stress in the material of these parts.

As piston rod 68 reciprocates, the wall of bore 110 oscillates about, and bears against, wrist pin 66 imparting a reciprocating motion to stepped piston 52. As stepped piston 52 is pulled towards the rotational axis of shaft 34 in an intake stroke, one-way check valve 96 flexes away from inlet openings 88 due to differential pressure and a refrigerant, e.g., carbon dioxide in the illustrated embodiment, is drawn into the compression chamber 40*a* defined within compression cavity 40 from inlet passageway 76 through openings 88. As stepped piston 52 moves away from the rotational axis of shaft 34 in a compression stroke, compression portion 54 of piston 52 compresses the refrigerant within compression cavity 40. When the refrigerant within compression chamber 40*a* has a pressure that is sufficient to bias valve member 81 away from outlet 86, the refrigerant is discharged through outlet 86 into discharge chamber 78. From discharge chamber 78, the high pressure refrigerant enters internal discharge line 48 and is then discharged from compressor assembly 10.

During operation of compressor assembly 10, journal 70 imparts a circular motion to bearing part 112. The motion of sleeve 108, however, is constrained to a reciprocating motion along axis A due to its connection with piston 52 which is located within stepped cylinder 36. Confining the movement of sleeve 108 to a reciprocating movement along axis A generates side load forces oriented perpendicular to both axis A and the rotational axis of shaft 34. These side load forces are transmitted from sleeve 108 to wrist pin 66 to guide portion 56 of piston 52 resulting in a side load being placed on stepped cavity 38 by stepped piston 52. As described above, the second clearance distance defined between outer surface 57 of guide portion 56 and sidewall 43 of guide cavity 42 is smaller than the first clearance distance defined between outer surface 55 of compression portion 54 and sidewall 41 of compression cavity 40. Consequently, it is the relatively larger guide portion 56 of piston 52 that bears against cylinder block 36 instead of the smaller diameter compression portion 54. Guide portion 56 thereby maintains the alignment of stepped piston 52 within stepped cavity 38 and limits or prevents direct contact between compression portion 54 of piston 52 and sidewall 41 of compression cavity 40. This facilitates the performance and longevity of piston rings 59 which engage sidewall 41 and are disposed in grooves 59 located in surface 55 to form a seal between piston 52 and sidewall 41 at one end of compression chamber 40*a*.

As mentioned above, outer surface 57 of the relatively large diameter guide portion 56 provides a large bearing surface, relative to compression portion 54, for bearing the side load placed on piston 52. The larger diameter guide portion 56 is also capable of defining a larger transverse void 64 compared to compression portion 54. This permits the use of a relatively large wrist pin 66 and sleeve 108 thereby also relatively increasing the surface area of bore 110 that bears against wrist pin 66. By providing an increased area for these bearing surfaces, the stress at these bearing surfaces can be reduced. The reduction of these stresses is particularly useful in compressors that utilize a refrigerant that must be compressed to a relatively high pressure such as carbon dioxide because an increase in the discharge pressure, without other compensating changes, will result in greater forces being applied to the piston. For example, when carbon dioxide is used as a refrigerant it is typically compressed to a supercritical pressure that is in excess of 1100 psia.

During the reciprocating movement of piston 52, guide portion 56 defines a varying volume 42*a* within cavity 42. In order to prevent a pressure differential between interior volume 20 and variable volume 42*a* from acting on the guide portion 56 of piston 52 and thereby degrading the performance of the compressor, stepped piston 52 includes a flat 102 defined on outer surface 57 of guide portion 56. Vent gap 104 is defined between flat 102 and sidewall 43 of guide cavity 42 and communicates with variable volume 42*a* to provide a vent passage through which oil and air may escape variable volume 42*a* during the compression stroke and enter variable volume 42*a* during the suction stroke. By positioning flat 102 in a horizontal orientation and so that it forms gap 104 along the upper section guide portion 56, the reduction in the surface area available for transferring horizontally directed side loads between guide portion 56 and guide cavity 42 caused by flat 102 is minimized. It should be understood that more than one flat may be defined on outer surface 57 to provide multiple gaps.

Referring to FIGS. 4 and 6-7, in addition to flat 102, stepped piston 52 also includes a plurality of vent holes or passageways 106 defined in guide portion 56. Vent passageways 106 extend from the end of guide portion 56 opposite end face 60 to central void 62 which is open to interior volume 20 via opening 61 in end face 60 thereby defining an axially extending passage for venting variable volume 42*a*. Thus, in addition to gap 104, air and oil within variable volume 42*a* may also be vented through passageways 106. Although FIGS. 4-7 show stepped piston 52 as including both flat 102 and passageways 106, the present invention also contemplates incorporating only one or the other of these venting features. Alternative embodiments may also vent variable volume 42*a* via a passageway formed in cylinder block 36 instead of piston 52.

While this invention has been described as having an exemplary design, the present invention may be further modified within the spirit and scope of this disclosure. This application is therefore intended to cover any variations, uses, or adaptations of the invention using its general principles.

What is claimed is:

1. A compressor assembly comprising:

a cylinder block, said cylinder block defining a cavity having a first cavity portion and a second cavity portion, said cavity defining a central axis extending through each of said first and second cavity portions, said first and second cavity portions respectively having first and second cavity sidewalls extending substantially parallel to said central axis, a cross section of said first cavity portion oriented perpendicular to said central axis defining a first cross sectional configuration and area and a cross section of said second cavity portion oriented perpendicular to said central axis defining a second cross sectional configuration and area, said second cross sectional area being greater than said first cross sectional area, the entire first cross sectional area of said first cavity portion being contiguous with said second cavity portion, and wherein said assembly defines an inlet in communication with said first cavity portion and an outlet in communication with said first cavity portion whereby a compressible fluid enters said first cavity portion through said inlet at a suction pressure and is discharged through said outlet at a discharge pressure; and a piston at least partially disposed in said cavity wherein said piston reciprocates along said central axis, said piston including a first piston portion and a second piston portion, said first piston portion having a cross sectional configuration and area substantially similar to said first cavity portion configuration and area, said second piston portion having a radially outer surface at least partially engageable with said second cavity sidewall, said second cavity portion being continuously vented during reciprocation of said piston, and wherein, during reciprocation of said piston within said cavity, said first piston portion compresses a fluid in said first cavity portion and forces transverse to said central axis are transferable between said radially outer surface of said second piston portion and said second cavity sidewall.

2. The compressor assembly of claim 1 wherein said first and second cavity portions are each substantially cylindrical.

3. The compressor assembly of claim 2 wherein said first and second cavity portions are coaxially disposed.

4. The compressor assembly of claim 1 wherein said assembly defines a first clearance distance between said first piston portion and said first cavity sidewall and a second clearance distance between said second piston portion and said second cavity sidewall with said piston centered in said cavity, said first clearance distance being greater than said second clearance distance.

5. The compressor assembly of claim 4 further comprising at least one piston ring disposed on said first piston portion wherein said piston ring sealingly engages said first piston portion and said first cavity sidewall.

6. The compressor assembly of claim 1 further comprising:

a crankshaft having a rotational axis disposed substantially perpendicular to said central axis and a journal portion having a journal axis parallel to and spaced from said rotational axis;

a linkage member coupled to said journal portion;

a wrist pin engaging said linkage member and said second piston portion wherein said wrist pin transfers a driving force from said linkage member to said piston.

7. The compressor assembly of claim 6 wherein said second piston portion defines a central void having an opening on an end face of said second piston portion and a transverse void intersecting said central void, said transverse void defining at least one opening in said radially outer surface of said second piston portion, said linkage member extending into said central void and said wrist pin partially disposed within said transverse void.

8. A compressor assembly comprising:

a cylinder block, said cylinder block defining a cavity having a first substantially cylindrical cavity portion and a second substantially cylindrical cavity portion, said first and second cavity portions being contiguously and coaxially disposed and defining a central axis, said second cavity portion defining a larger diameter than said first cavity portion, said assembly defines an inlet in communication with said first cavity portion and an outlet in communication with said first cavity portion whereby a compressible fluid enters said first cavity portion through said inlet at a suction pressure and is discharged through said outlet at a discharge pressure;

a piston at least partially disposed in said cavity wherein said piston reciprocates along said central axis, said piston including a first piston portion and a second piston portion, said first piston portion defining a cylindrical shape substantially similar to said first cavity portion, said second piston portion having a radially outer surface at least partially engageable with a sidewall of said second cavity portion, said second cavity portion being continuously vented during reciprocation of said piston;

a crankshaft having a rotational axis disposed substantially perpendicular to said central axis;

a linkage assembly drivingly coupling said crankshaft to said piston; and wherein, during reciprocation of said piston in said cavity, said first piston portion compresses a fluid in said first cavity portion and forces transverse to said central axis are transferable between said radially outer surface of said second piston portion and said sidewall of said second cavity portion.

9. The compressor assembly of claim 8 wherein said crankshaft includes a journal portion defining a journal axis parallel to and spaced from said rotational axis and said linkage assembly comprises a linkage member coupled to said journal portion and a wrist pin engaging said linkage member and said second piston portion wherein said wrist pin transfers a driving force from said linkage member to said piston.

10. The compressor assembly of claim 9 wherein said second piston portion defines a central void having an opening on an end face of said second piston portion and a transverse void intersecting said central void, said transverse void defining at least one opening in said radially outer surface of said second piston portion, said linkage member extending into said central void and said wrist pin partially disposed within said transverse void.

11. The compressor assembly of claim 8 wherein said assembly defines a first clearance distance between said first piston portion and said first cavity portion and a second clearance distance between said second piston portion and said second cavity portion with said piston centered in said cavity, said first clearance distance being greater than said second clearance distance.

12. The compressor assembly of claim 11 further comprising at least one piston ring disposed on said first piston portion wherein said piston ring sealingly engages said first piston portion and a sidewall of said first cavity portion.

13. The compressor assembly of claim 8 further comprising a motor coupled to said crankshaft and a hermetically sealed housing, said motor, crankshaft, piston and cylinder block being disposed within said housing.

14. The compressor assembly of claim 13 wherein said housing defines an interior volume, said motor and cylinder block disposed within said interior volume, said interior volume containing compressible fluid at a suction pressure.

15. The compressor assembly of claim 8 wherein said cylinder block includes a detachable plate defining one end of said first cavity portion, said plate defining said inlet and said outlet.

16. A method of compressing a refrigerant vapor, said method comprising:

providing a cylinder block having a cavity;

providing a piston defining a piston axis, said piston having a first piston portion and a second piston portion wherein a cross section of said first piston portion oriented perpendicular to said piston axis defines a first cross sectional area and a cross section of said second piston portion oriented perpendicular to said piston axis defines a second cross sectional area, said second cross sectional area being greater than said first cross sectional area, said second piston portion at least partially defining a vent;

disposing said piston at least partially within said cavity, said first piston portion defining a compression chamber within said cavity;

reciprocating said piston along a central axis of the cavity by drivingly engaging said second piston portion; and compressing the refrigerant in the compression chamber with said first piston portion as said piston is reciprocated.

17. The method of claim 16 wherein said method further comprises introducing a refrigerant comprising carbon dioxide into said compression chamber and discharging said refrigerant at a supercritical pressure from said compression chamber after compressing the refrigerant with said first piston portion.

18. The method of claim 16 further including the step of maintaining the alignment of said piston during reciprocating movement of said piston by engaging a radially outer surface of said second piston portion with a sidewall of said cavity.

19. The method of claim 16 wherein reciprocating said piston along a central axis of said cavity by drivingly engaging said second piston portion comprises rotating a crankshaft along a rotational axis and coupling said second piston portion to said crankshaft with a linkage assembly.

* * * * *